US006749291B2

(12) United States Patent
Satou et al.

(10) Patent No.: US 6,749,291 B2
(45) Date of Patent: Jun. 15, 2004

(54) INKJET RECORDING DEVICE THAT REUSES REFRESH INK

(75) Inventors: Kunio Satou, Hitachinaka (JP); Takahiro Yamada, Hitachinaka (JP); Hitoshi Kida, Hitachinaka (JP); Akemi Ouchi, Hitachinaka (JP); Tsutomu Maekawa, Hitachinaka (JP); Hidetoshi Fujii, Hitachinaka (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 0 days.

(21) Appl. No.: 10/405,497

(22) Filed: Apr. 3, 2003

(65) Prior Publication Data

US 2003/0189625 A1 Oct. 9, 2003

(30) Foreign Application Priority Data

Apr. 5, 2002 (JP) ..... P2002-103614

(51) Int. Cl.[7] ..... B41J 2/09; B41J 2/165; B41J 2/175

(52) U.S. Cl. ..... 347/77; 347/36; 347/85; 347/93

(58) Field of Search ..... 347/93, 77, 82, 347/30, 31, 36, 85; 430/110.4

(56) References Cited

U.S. PATENT DOCUMENTS

| | | | | | |
|---|---|---|---|---|---|
| 4,122,458 | A | * | 10/1978 | Paranjpe | 347/77 |
| 4,190,844 | A | * | 2/1980 | Taylor | 347/82 |
| 4,544,930 | A | * | 10/1985 | Paranjpe | 347/77 |
| 4,612,553 | A | * | 9/1986 | Kohler | 347/6 |
| 6,416,918 | B2 | * | 7/2002 | Matsumura et al. | 430/110.4 |
| 6,508,542 | B2 | * | 1/2003 | Sharma et al. | 347/77 |

FOREIGN PATENT DOCUMENTS

JP 11-334103 12/1999

* cited by examiner

*Primary Examiner*—Anh T. N. Vo
(74) *Attorney, Agent, or Firm*—Whitham, Curtis & Christofferson, PC

(57) ABSTRACT

An inkjet head selectively ejects recording ink droplets and refresh ink droplets. The recording ink droplets are deflected so as to impinge on target locations on a recording medium, thereby forming recording dots thereon. On the other hand, the refresh ink droplets are deflected so as to impinge on an ink absorbing member. The ink clinging on the ink absorbing member is collected into an ink tank and reused. The ink absorbing member functions as a filter for preventing impurities being collected into the ink tank along with the ink.

10 Claims, 4 Drawing Sheets

INKJET RECORDING DEVICE THAT REUSES REFRESH INK

BACKGROUND OF THE INVENTION

1. Field of the Invention

The present invention relates to a high-speed inkjet recording device that reuses refresh ink.

2. Related Art

Line-scan inkjet printers are a type of high-speed inkjet printer capable of printing on a continuous recording sheet at high speeds, and include an elongated inkjet recording head formed with rows of nozzles for ejecting ink droplets. The head is arranged in confrontation with the surface of the recording sheet across the entire width of the recording sheet. The head selectively ejects ink droplets from the nozzles based on a recording signal and impinges the droplets on desired positions across the width of the recording sheet. At the same time, the recording sheet is transported rapidly in its lengthwise direction, which serves as a main scanning operation, so that images can be recorded at any place on the recording sheet.

Various types of line-scan inkjet printers have been proposed, such as printers that use a continuous inkjet type recording head and printers that use a drop-on-demand type recording head. Although drop-on-demand type line-scan inkjet printers have a slower printing speed than do continuous inkjet type line-scan inkjet printers, they have an extremely simple ink system and so are well suited for a general-purpose high-speed printer.

Because the drop-on-demand inkjet recording device ejects ink droplets only when needed, non-ink-ejection periods occur during printing operations. During such non-ink-ejection periods, the ink clinging around nozzles may get dense. Condensed ink prevents proper ink ejection, and in a worse case blocks off the nozzles, thereby disabling ink ejection.

Although such a problem does not occur in the continuous-type inkjet recording device, this is a serious problem in the drop-on-demand type inkjet recording device.

Japanese Patent-Application Publication (Kokai) No. HEI-11-334103 discloses an inkjet recording device that reuses ink, which was removed and collected from an ink ejection surface of an inkjet head.

However, when collecting ink from the ink ejection surface of the inkjet head, impurities, such as dust, are also collected along with the ink. Reusing ink containing such impurities easily causes nozzle blockage, degrading reliability of ink ejection.

SUMMARY OF THE INVENTION

In the view of foregoing, it is an object of the present invention to overcome the above problems, and also to provide an inkjet recording device capable of ejecting refresh ink during printing operations and reusing the refresh ink by collecting the same.

In order to attain the above and other objects, the present invention provides an inkjet recording device including an inkjet member that ejects an ink droplet, an ink tank that stores ink, wherein the ink is supplied to the inkjet member, an ink receiving member that receives the ink droplet, a deflecting means for deflecting the ink droplet so as to impinging the ink droplet on the ink receiving member, and a collecting means for collecting ink from the ink receiving member and supplying the collected ink to the ink tank.

PREFERRED EMBODIMENT OF THE PRESENT INVENTION

Next, a preferred embodiment of the present invention will be described with reference to the accompanying drawings.

Figure 1:
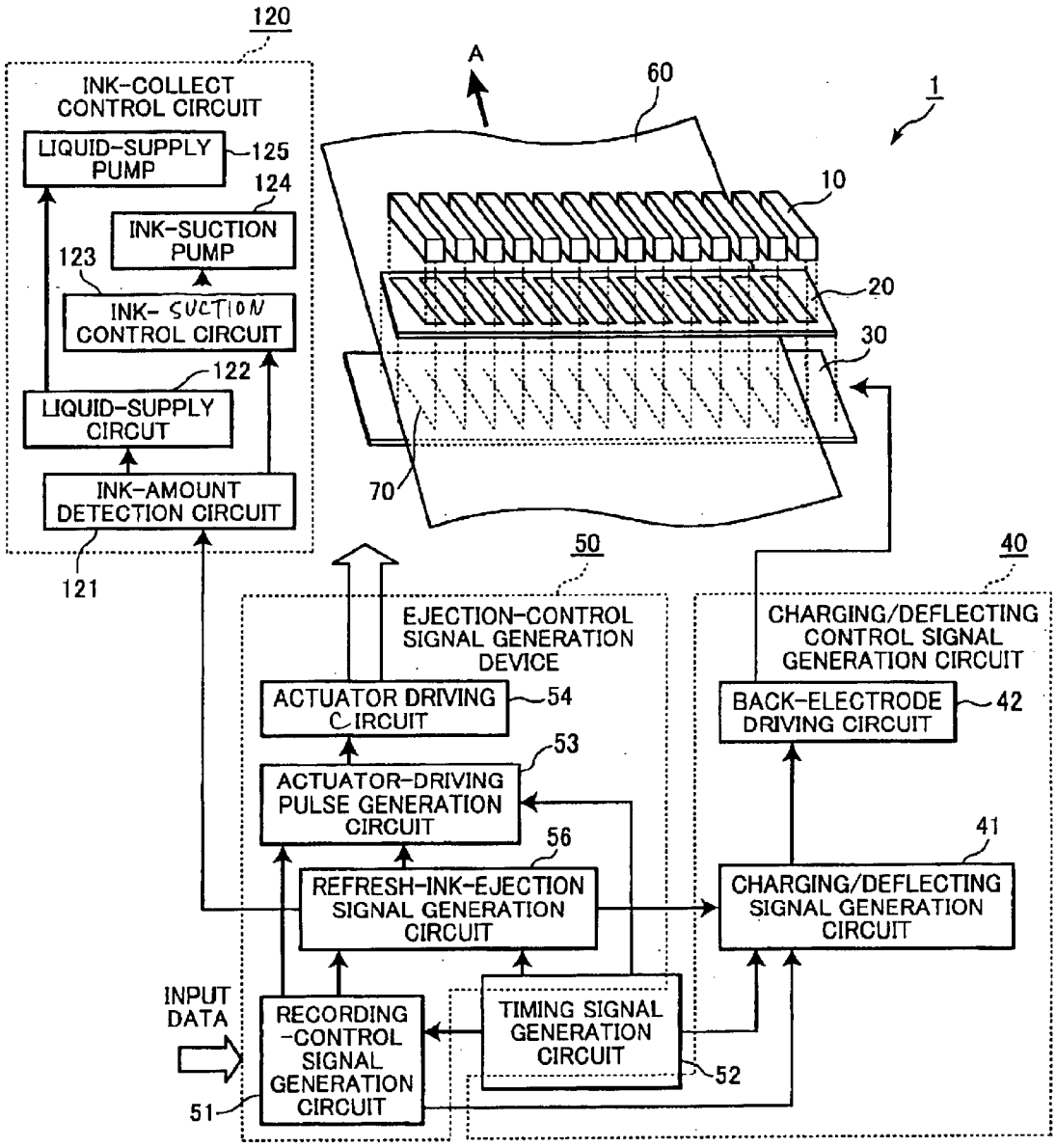
FIG. 1 is exploded perspective view partially in block diagram showing a configuration of an inkjet recording device according to an embodiment of the present invention.

FIG. 1 shows an inkjet recording device 1 according to an embodiment of the present invention. The inkjet recording device 1 is an ink-droplet deflection drop-on-demand line-scan recording device. As shown in FIG. 1, the inkjet recording device 1 includes a plurality of recording head modules 10, a recording head module mounter 20, a back electrode 30, a charging/deflecting control signal generation circuit 40, an ejection-control signal generation device 50, and an ink-collect control circuit 120.

The recording head module mounter 20 mounts the plurality of recording head modules 10. The back electrode 30 is disposed at the rear of a recording sheet 60 so as to confront the recording head module mounter 20 via a sheet transport path. The charging/deflecting control signal generation circuit 40 is for supplying charging/deflecting signals to the back electrode 30. The ejection-control signal generation device 50 is for controlling ejection of ink droplets based on input data from an external device.

The charging/deflecting control signal generation circuit 40 includes a charging/deflecting signal generation circuit 41 and a back-electrode driving circuit 42. The ejection-control signal generation device 50 includes a recording-control signal generation circuit 51, a timing signal generation circuit 52, an actuator-driving-pulse generation circuit 53, an actuator driving circuit 54, and a refresh-ink-ejection signal generation circuit 56.

The timing signal generation circuit 52 generates a timing signal, and outputs the timing signal to the recording-control signal generation circuit 51, the actuator-driving-pulse generation circuit 53, the refresh-ink-ejection signal generation circuit 56, and the charging/deflecting signal generation circuit 41.

The recording-control signal generation circuit 51 generates recording-control signals based on the input data and the timing signal, and outputs the same to the actuator-driving-pulse generation circuit 53, the refresh-ink-ejection signal generation circuit 56, and the charging/deflecting signal generation circuit 41. The refresh-ink-ejection signal generation circuit 56 generates a refresh-ink-ejection actuator driving signal based on the recording-control signal, and outputs the same to the actuator-driving-pulse generation circuit 53, the charging/deflecting signal generation circuit 41, and the ink-collect control circuit 120. The actuator-driving-pulse generation circuit 53 generates a recording pulse signal based on the recording-control signal and also generates a refresh-ink-ejection pulse signal based on the refresh ink-ejection-actuator driving signal. The recording pulse signal and the refresh-ink-ejection pulse signal are both ejection-control signal for driving an actuator 55 (FIG. 3) of the recording head module 10 to be described later. The actuator driving circuit 54 amplifies the recording pulse signal and the refresh-ink-ejection pulse signal to an appropriate level for driving the actuator 55.

Figure 5:
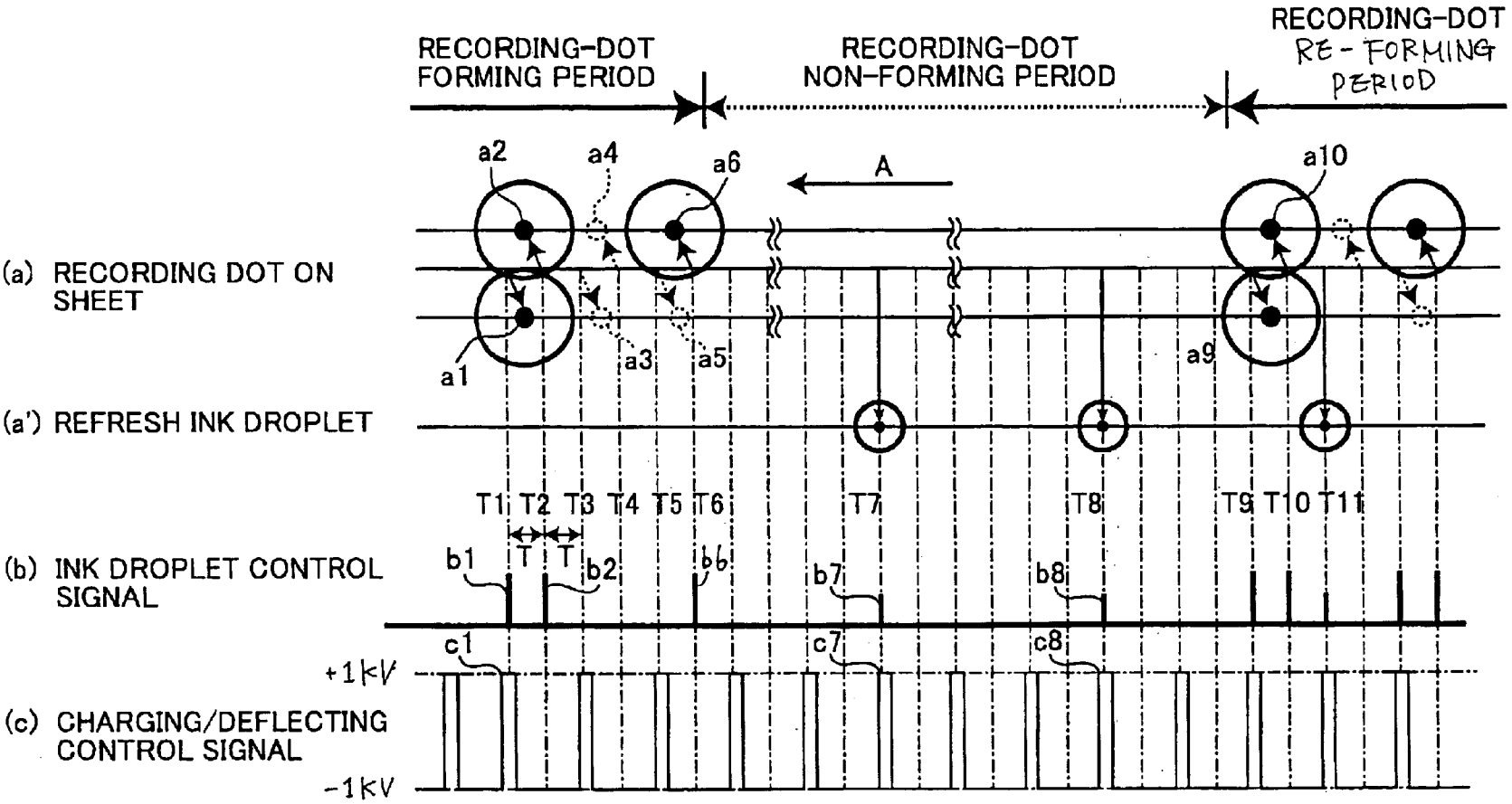
FIG. 5 is an explanatory view showing recording operations and ink refresh operations performed by the inkjet recording device of FIG. 1.

The charging/deflecting signal generation circuit 41 generates a predetermined charging/deflecting signal (voltage) based on the timing signal from the timing signal generation circuit 52 and on the recording control signal from the recording-control-signal generation circuit 51 or on the refresh-ink-ejection actuator driving signal from the refresh-ink-ejection-signal generation circuit 56, and output the same to the back-electrode driving circuit 42. The back-electrode driving circuit 42 amplifies the charging/deflecting signal to a predetermined voltage, and then outputs the same to the back electrode 30. As shown in FIG. 5(*c*), the charging/deflecting voltage from the back-electrode driving circuit 42 periodically changes between +1 KV and −1 KV.

Figure 2:
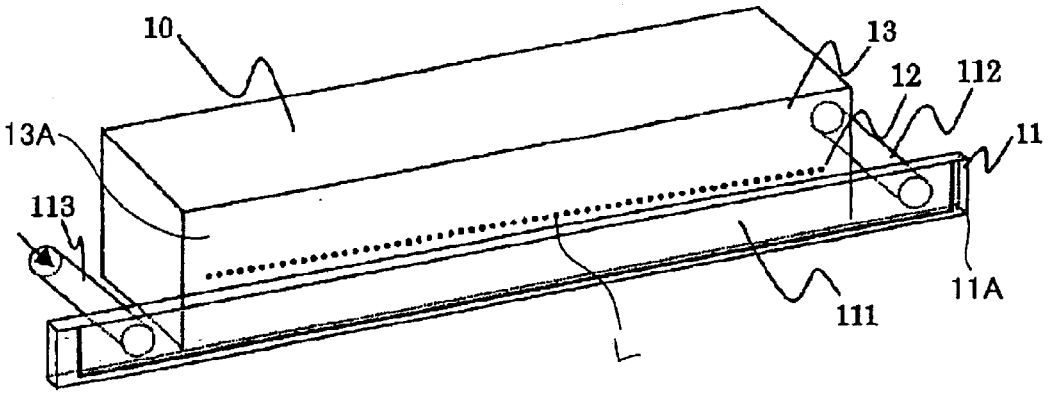
FIG. 2 is an enlarged perspective view of a recording head module of the inkjet recording device of FIG. 1.

Next, configuration of the recording head module 10 will be described. The recording head module 10 is a drop-on-demand linear inkjet recording head module. As shown in FIG. 2, each recording head module 10 has an orifice plate 13 made of conductive material, such as metal. The orifice plate 13 is formed with an orifice row L including n-number of orifices 12 aligned equidistance from one another. Each orifice 12 has a diameter of about 30 $\mu$m, for example. The orifice plate 13 has an orifice surface 13A, on which an orifice electrode/ink receiving member 11 is provided. The orifice electrode/ink receiving member 11 serves as an electrode for generating an angled electric field and as an ink collector for receiving refresh ink droplets.

Figure 3:
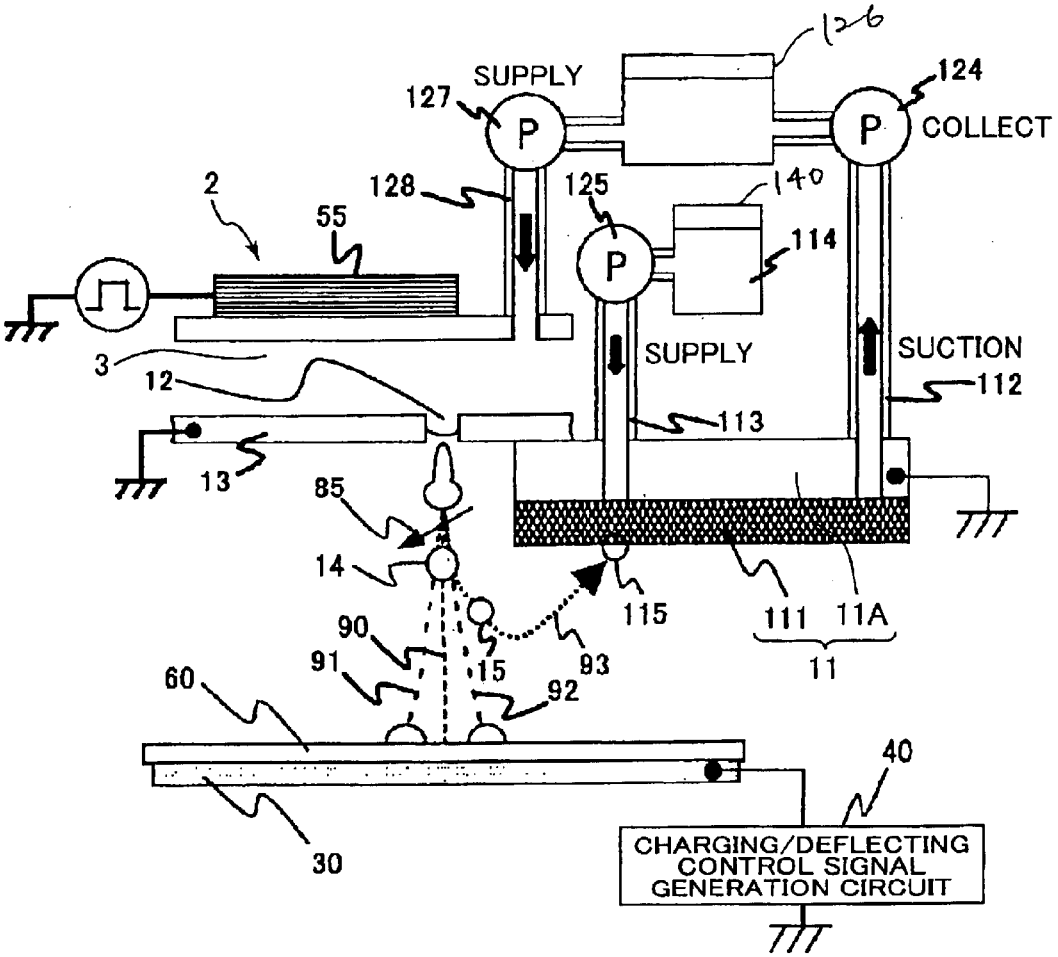
FIG. 3 is an explanatory diagram of the inkjet recording device of FIG. 1.

The recording head module 10 will be described further. As shown in FIG. 3, the recording head module 10 has n-number of nozzle elements 2 (only one nozzle element 2 is shown in FIG. 3). The nozzle elements 2 have the same configuration, and each has the orifice 12 formed in the orifice plate 13, a pressure chamber 3, and the actuator 55, such as a piezoelectric element. The pressure chamber 3 has the orifice 12 as its opening end, and houses ink therein. The actuator 55 is attached to the pressure chamber 3. The ink-droplet-ejection control signal from the ink-droplet-ejection control signal generation device 50 is input to the actuator 55. Although not shown in the drawings, each recording head module 10 is further formed with ink inlet ports for introducing ink to the pressure chambers 3 and a manifold for supplying ink to the ink inlet ports.

When the ejection-control signal from the ejection-control signal generation device 50 is applied to the actuator 55, then the actuator 55 changes the volume of the pressure chamber 3, thereby ejecting an ink droplet through the orifice 12. In the present embodiment, when the ejection-control signal from the ejection-control signal generation device 50 is the recording pulse signal, then a recording ink droplet 14 with a mass of about 10 ng is ejected in an ejection direction, that is a direction perpendicular to the recording sheet 60, at a velocity of 5 m/s. On the other hand, when the ejection-control signal is the refresh-ink-ejection pulse signal, then a refresh ink droplet 15 with a mass of about 7 ng is ejected in the ejection direction at a velocity of 2.5 m/s. Thus ejected ink droplets 14, 15 will fly straight along an undeflected ink droplet flying path 90 and impinge on the recording sheet 60 if not deflected. However, in the present embodiment, the ink droplets 14, 15 are deflected. Details will be described later.

The orifice electrode/ink receiving member 11 shown in FIG. 2 includes an electrically conductive plate 11A made of metal or the like to a thickness of about 0.5 mm, for example. In the present embodiment, the plate 11A is attached on the orifice surface 13A of the orifice plate 13 about 300 $\mu$m away from and parallel to the orifice row L. The orifice electrode/ink receiving member 11, the orifice plate 13, and the ink inside the nozzle elements 2 are all grounded.

As shown in FIGS. 2 and 3, the orifice electrode/ink receiving member 11 also includes an ink absorbing member 111 embedded in a lower surface of the plate 11A. The ink absorbing member 111 has a thickness of about 0.2 mm. It is preferable that the ink absorbing member 111 be a plate made of stainless steel fibers or a porous stainless steel of sintered compact in terms of its ink absorbency, electrode function, and gap between the recording sheet 60. As shown in FIG. 2, the ink absorbing member 111 is connected to an ink absorbing pipe 112 and a colorant-dispersion liquid supply pipe 113. Ink in the ink absorbing member 111 spreads due to capillary action, and is discharged through the ink absorbing pipe 112. The colorant-dispersion liquid supply pipe 113 is for supplying colorant-dispersion liquid to the ink absorbing member 111.

As shown in FIGS. 1 and 3, the back electrode 30 is a flat plate formed of conductive material, such as metal, and is disposed parallel to the orifice surface 13A at a position about 1.5 mm distanced from the orifice surface 13A. Because the charging/deflecting control voltage from the charging/deflecting control signal generation circuit 40 is applied to the back electrode 30, the back electrode 30 has a potential corresponding to the charging/deflecting control voltage. Because the charging/deflecting control voltage of the present embodiment changes between +1 KV and −1 KV as mentioned above, the voltage of the back electrode 30 also changes between +1 KV and −1 KV.

Figure 4:
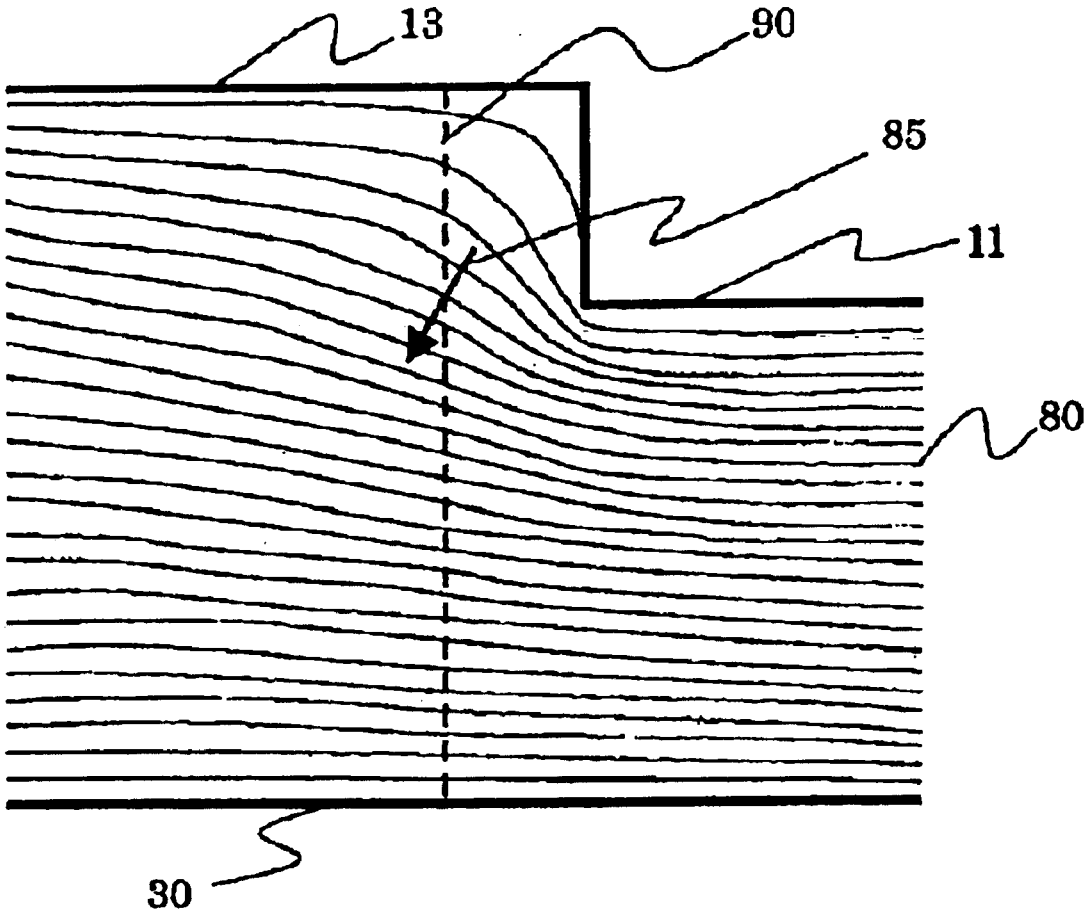
FIG. 4 shows an equipotential surface of an angled deflection electric field.

As described above, the orifice electrode/ink receiving member 11 and the orifice plate 13 are grounded. Therefore, when the charging/deflecting control voltage is applied to the back electrode 30, then an electric field is generated among the orifice electrode/ink receiving member 11 and the orifice plate 13 and the back electrode 30. FIG. 4 shows an equipotential surface 80 of the electric field. As will be understood from FIG. 4, the direction of the electric field is angled with respect to the ejection direction near the undeflected ink droplet flying path 90, thereby generating the angled electric field 85.

Therefore, in FIG. 3, the ink droplets 14, 15 ejected through the orifice 12 are charged because of the charging/deflecting control signal generated in the charging/deflecting control signal generation circuit 40, and then deflected to a direction perpendicular to the undeflected ink droplet flying path 90, i.e., in a direction perpendicular to the ejection direction, by the angled electric field 85.

More specifically, an ink droplet ejected through the orifice 12 is positively or negatively charged with a predetermined charging amount depending on the potential of the back electrode 30 at the time of the ejection, and then deflected by the angled electric field 85. A positively charged recording ink droplet 14 is deflected leftward in FIG. 3 by the angled electric field 85, and flies along a flight path 91. On the other hand, a negatively charged recording ink droplet 14 is deflected rightward in FIG. 3 by the angled electric field 85, and flies along a flight path 92. Therefore, by controlling ejection and nonejection of a recording ink droplet 14 and by controlling a deflection direction of a recording ink droplet 14, it is possible to form a desired image with recording dots 70 (FIG. 1) on the recording sheet 60.

Here, as will be understood from FIG. 4, the angled electric field 85 at an early flight stage of a recording ink droplet 14 is more angled with respect to the undeflected ink droplet flying path 90 than at a later flight stage. This enables to greatly deflect the recording ink droplet 14 in its early flight stage, and also to further deflect the recording ink droplet 14 while the recording ink droplet 14 keeps flying. In this manner, it is possible to effectively deflect the charged recording ink droplet 14. Here, when the charged recording ink droplet 14 is deflected by the angled electric field 85, the ink droplet 14 is accelerated or decelerated by the angled electric field 85 in the ink droplet ejection direction depending on its polarity.

On the other hand, the refresh ink droplet 15 is set to be negatively charged, and as shown in FIG. 3, reaches the ink absorbing member 111 after flying along a U-turned flight path 93. This is because that the refresh ink droplet 15 is lighter in weight and ejected at a lower ejection speed than the recording ink droplet 14, and that the refresh ink droplet 15 is easily deflected by the angled electric field 85.

The ink-collect control circuit 120 is for generating control signal for collecting ink, and includes an ink-amount detection circuit 121, a liquid-supply control circuit 122, an ink-suction control circuit 123, an ink-suction pump 124, and a liquid-supply pump 125. The ink-amount detection circuit 121 is for detecting ink amount of refresh ink droplet 15 impinged on the orifice electrode/ink receiving member 11 (refresh ink 115 in FIG. 3) and outputting detection signals accordingly. The liquid-supply pump 125 is for supplying the colorant-dispersion liquid to the orifice electrode/ink receiving member 11 through the colorant-dispersion liquid supply pipe 113. The ink-suction pump 124 is for removing refresh ink 115 from the orifice electrode/ink receiving member 11 through the ink absorbing pipe 112. The liquid-supply control circuit 122 is for controlling the amount of the colorant-dispersion liquid that the liquid-supply pump 125 supplies to the orifice electrode/ink receiving member 11 in accordance with the detection signal from the ink-amount detection circuit 121. The ink-suction control circuit 123 is for controlling a suction force of the ink-suction pump 124 in accordance with the detection signal of the ink-amount detection circuit 121 so as to control the collecting amount of the refresh ink 115.

Next, an operation of the inkjet recording device 1 will be described while referring to a specific example. In a recording operation in this example, recording ink droplets 14 ejected from a single orifice 12 are deflected. In this recording operation, while keep feeding a recording sheet 60, as shown in FIG. 5, a recording-dot forming period for forming recording dots on the recording sheet 60 and a recording-dot non-forming period for forming no recording dots are alternatively repeated. Here, the recording-dot non-forming period includes, for example, periods between letters, between ruled lines, and between graphics where no recording dots are formed. The recording-dot non-forming period also includes a recording sheet transporting period between pages where no recording dots are formed. In the present embodiment, a recording-dot forming period following a recording-dot non-forming period is referred to as a recording-dot re-forming period.

FIG. 5(*a*) shows recording dots formed on the recording sheet 60, and FIG. 5(*a*') shows refresh ink droplets 15. FIG. 5(*b*) shows the ejection-control signals (recording pulse signals and refresh-ink-ejection pulse signals) from the ejection-control signal generation device 50. FIG. 5(*c*) shows the charging/deflecting control signal generated in the charging/deflecting control signal generation circuit 40. It should be noted that the recording sheet 60 is transported in a direction indicated by an arrow A at a constant speed by a transporting mechanism (not shown).

First, in a first recording-dot forming period, a recording pulse b1 is applied to the actuator 55 at a time T1 shown in FIG. 5(*b*). As a result, a recording ink droplet 14 is ejected through an orifice 12 slightly after the time T1. At this time, a charging/deflection control voltage c1 of +1 KV is being applied to the back electrode 30, so that the recording ink droplet 14 ejected in response to the pulse b1 is negatively charged, and flies toward the recording sheet 60. During the flight, as shown in FIG. 5(*c*), the charging/deflection control voltage is switched to −1 KV, whereby the angled electric field 85 is generated. The charged recording ink droplet 14 is deflected by the angled electric field 85, flies along the flight path 92 shown in FIG. 3, and form a recording dot on the recording sheet 60 at a dot position a1 (FIG. 5(*a*)). Here, the recording ink droplet 14 is decelerated during its flight.

When a time period T elapses, as shown in FIG. 5(*b*), a pulse b2 is applied to the actuator 55 at a time T2. As a result, a recording ink droplet 14 is ejected slightly after the time T2. At this time, a charging/deflection control voltage of −1 KV (FIG. 5(*c*)) is being applied to the back electrode 30, so that the recording ink droplet 14 ejected in response to the pulse b2 is positively charged. Because the charging/deflection control voltage is maintained of −1 KV while the positively charged recording ink droplet 14 is flying, the recording ink droplet 14 is deflected by the angled electric field 85 and flies along the flight path 91 shown in FIG. 3. Eventually, the recording ink droplet 14 impinges on the recording sheet 60, and forms a recording dot on a dot location a2 (FIG. 5(*a*)). In this case, the recording ink droplet 14 is accelerated during the flight.

When a next time duration T elapses, no pulse signal is applied to the actuator 55 at a time T3 (FIG. 5(*b*)), so that no ink droplet is ejected. Accordingly, no recording dot is formed on a dot location a3 shown in FIG. 5(*a*). When next and subsequent time durations T elapse, no ink droplet is ejected at time T4 or T5, so that no recording dot is formed on dot locations a4 and a5.

At time T6, in the same manner as when the recording dot is formed on the dot location a2 (FIG. 5(*a*)), an recording ink droplet 14 ejected in response to a recoding pulse b6 is positively charged because of the charging/deflecting control signal of −1 KV. The recording ink droplet 14 is deflected by the angled electric field 85 and forms a recording dot on a dot location a6. After repeatedly performing the above operations, a desired image is obtained on the recording sheet 60 as shown in FIG. 5(*a*).

After the above operations in the recording-dot forming period complete, a recording-dot non-forming period starts. In this period, no ink droplet 14 is ejected through the orifice 12. Therefore, there is a danger that ink clinging around the orifice 12 gets dense, and that thus condensed ink prevents stable ejection of the recording ink droplet 14 at the early stage of the recording-dot reforming period, preventing precise recording.

In order to overcome the above problems, in the present embodiment, refresh ink droplets 15 are ejected at predetermined timing during the recording-dot non-forming period. That is, as shown in FIG. 5(*b*), refresh-ink-ejection pulse signals b7 and b8 are applied to the actuator 55 at time T7 and T8, respectively. Because the width of the refresh-ink-ejection pulse signals b7 and b8 is set smaller than that of the recording pulses b1 and b2, it is possible to eject light refresh ink droplets 15 at a reduced ejection speed compared with the recording ink droplets 14. These refresh ink droplets 15 are negatively charged by the charging/deflecting control signals c7 and c8 of +1 KV, respectively, and start flying toward the recording sheet 60. However, because the refresh ink droplets 15 are light and ejected at the reduced speed, the refresh ink droplets 15 are decelerated by the angled electric field 85 and forced back toward the orifice plate 13. At the same time, the refresh ink droplets 15 are deflected in a direction perpendicular to the ejection direction by the angled electric field 85. As a result, the refresh ink droplets 15 fly along the U-turned flight path 93 shown in FIG. 3 as described above, and reaches the ink absorbing member 111 of the orifice electrode/ink receiving member 11.

It should be noted that if the voltage of the charging/deflecting control signals c7, c8 for the refresh ink droplets 15 is set greater than that of the charging/deflecting control signal c1 and the like for the recording ink droplets 14, the refresh ink droplet 15 is charged to a greater charging amount. This makes easier to deflect the refresh ink droplet 15 in U-turn. Accordingly, the refresh ink droplet 15 is further reliably collected while reliably preventing the refresh ink droplet 15 from impinging on the recording sheet 60.

When the above recording-dot non-forming period ends, the recording-dot re-forming-period starts. Recording ink droplets 14 are ejected at time T9 and T10, and recording dots are formed on dot locations a9 and a10. Because the above-described ink refresh operations prevent the ink clinging near the orifice 12 from getting dense, the recording ink droplets 14 are properly and stably ejected even at the time T9 and time T10 which are relatively early stage of the recording-dot re-forming period. Therefore, the recording dots are properly formed on the dot locations a9 and a10.

As described above, it is possible to individually and precisely control each one of refresh ink droplets 15. Therefore, it is possible to eject a necessary amount of, that is, even one refresh ink droplet 15, at an optimum timing. The refresh ink droplets 15 can be ejected at predetermined timings not only during the recording-dot non-forming period but also during the recording-dot forming period also. For example, it is possible to eject a refresh ink droplet 15 at a time 11 at which no recording ink droplet 14 is ejected.

Accordingly, there is no need to perform ink refresh with respect to all of the nozzle elements 2 at the same time. Because it is possible to perform ink refresh even during normal printing operations, decrease in throughput can be prevented while maintaining proper ink ejecting performance.

Moreover, because the ink absorbing member 111 is embedded in the plate 11A of the orifice electrode/ink receiving member 11, the ink absorbing member 111 does not cause paper jam. Further, it is unnecessary to increase a gap between the recording head module 10 and the recording sheet 60 in order to place the ink absorbing member 111, so that preciseness in recording is prevented from degrading.

Although detailed description will be omitted, the inkjet recording device 1 of the present embodiment can control a plurality of recording ink droplets 14 ejected from adjacent plural nozzle elements 2 to impinge on a single pixel location in an overlapping manner. Therefore, even if one or more of nozzle elements 2 become defective, it is possible to form recording dots 70 using remaining nozzle elements 2. That is, the problem of missing information due to defective nozzle elements 2 can be prevented. Moreover, unevenness in color density of resultant images due to unevenness in characteristics of the nozzle elements 2 can be avoided, thereby enhancing reliability in printing operations.

Here, ejected refresh ink droplets 15 impinge on the ink absorbing member 111 as described above. Referring to FIG. 3, refresh ink 115 clinging on the ink absorbing member 111 is absorbed into the ink absorbing member 111 and then sucked out through the ink absorbing pipe 112. However, if the refresh ink 115 solidifies on the ink absorbing member 111, then this degrades ink absorbency and ink collecting capability of the ink absorbing member 111.

In order to prevent such problems, in the present embodiment, colorant-dispersion liquid 114 contained in a liquid tank 140 is supplied to the ink absorbing member 111 by using the liquid-supply pump 125 and the colorant-dispersion liquid supply pipe 113. In addition, the ink-suction pump 124 removes and collects the refresh ink 115 from the ink absorbing member 111 through the ink absorbing pipe 112 into an ink tank 126. In this manner, the refresh ink 115 is prevented from drying out on the ink absorbing member 111, maintaining ink absorbency and ink collecting capability of the ink absorbing member 111.

The amount of the refresh ink droplets 15 impinged on the ink absorbing member 111 (the amount of the refresh ink 115) is detected by the ink-amount detection circuit 121, and the liquid-supply control circuit 122 controls the amount of colorant-dispersion liquid 114 to supply based on the detected amount of the refresh ink 115. Also, the ink-suction control circuit 123 controls the suction force of the ink-suction pump 124 based on the detected amount of the refresh ink 115. In this manner, the amount of the colorant-dispersion liquid 114 to be supplied to the ink absorbing member 111 is controlled such that mixture of the refresh ink 115 and the colorant-dispersion liquid 114 supplied to the ink absorbing member 111 will not fall in drops. It is preferable to locate the colorant-dispersion liquid supply pipe 113 vicinity of where the refresh ink droplets 15 impinge. Here, the ink-amount detection circuit 121 detects the amount of the refresh ink droplets 15 based on the refresh-ink-ejection actuator driving signals from the refresh-ink-ejection signal generation circuit 56.

The ink collected into the ink tank 126 is mixed with fresh ink contained therein, and is supplied to the pressure chambers 3 by a supply pump 127 through a supply pipe 128. Because the ink absorbing member 111 serves as a filter that prevents impurities from being collected into the ink tank 126 along with ink, the collected ink can be reused as is.

Here, if water-based ink is used, then the colorant-dispersion liquid 114 is preferably diluted solution containing at least water.

It is preferable that the pore diameter of the filter, that is, the ink absorbing member 111, be greater than the diameter of colorant in the ink. It is also preferable that the ink be pigmented ink and that the average diameter of the pigment be equal to or less than 150 nm for the following reasons. That is, because pigment particles of the pigmented ink are dispersed in a solvent, the pigment particles cling on a surface of a recording sheet, preventing blur. If the diameter of the pigment particle exceeds 150 nm, then there is a danger that the pigment particles precipitate in solution. Also, image printed on a recording sheet with pigmented ink whose pigment has an average diameter of greater than 150 nm have poor abrasion resistance.

As described above, the refresh ink droplet 15 is collected and reused, the inkjet recording device 1 of the present embodiment can prevent waste of ink for environmental conservation.

While some exemplary embodiments of this invention have been described in detail, those skilled in the art will recognize that there are many possible modifications and variations which may be made in these exemplary embodiments while yet retaining many of the novel features and advantages of the invention.

For example, the ink collected from the ink absorbing member 111 are introduced into the ink tank 126 and mixed with ink contained therein. This may reduce ink density. Therefore, a mechanism for maintain a uniform density of the ink in the ink tank 126 could be provided.

Although each of the recording head modules 10 of the above embodiment is provided with one ink absorbing pipe 112 and one colorant-dispersion liquid supply pipe 113, it is possible to provide two or more ink absorbing pipes 112 and two or more colorant-dispersion liquid supply pipes 113 to each recording head module 10. This enhances ink-collect capability.

Also, the refresh ink droplet 15 is deflected to travel along the U-turn path 93 in the above embodiment. However, the present invention can be applied to different type of inkjet printers that eject refresh ink.

What is claimed is:

1. An inkjet recording device comprising:

an inkjet member that ejects an ink droplet;

an ink tank that stores ink, wherein the ink is supplied to the inkjet member;

an ink receiving member that receives the ink droplet;

a deflecting means for deflecting the ink droplet to impinge the ink droplet on the ink receiving member; and a collecting means for collecting ink from the ink receiving member into the ink tank, wherein the collecting means functions as a filter for preventing impurities from being collected into the ink tank along with the ink.

2. The inkjet recording device according to claim 1, wherein the ink receiving member is provided with an ink absorbing member.

3. The inkjet recording device according to claim 1, wherein the inkjet member is formed with a plurality of nozzles through which ink droplets are ejected, the plurality of nozzles being aligned in a row.

4. The inkjet recording device according to claim 1, wherein the ink receiving member is provided common to all the nozzles.

5. The inkjet recording device according to claim 1, wherein the inkjet member selectively ejects an refresh ink droplet and a recording ink droplet, and the deflecting means deflects the refresh ink droplet to impinge the refresh ink droplet on the ink receiving member, and the deflecting means deflects the recording ink droplet to impinge the recording ink droplet on a recording medium at a target position.

6. An inkjet recording device, comprising:

an inkjet member that ejects an ink droplet;

an ink tank that stores ink, wherein the ink is supplied to the inkjet member;

an ink receiving member that receives the ink droplet;

a deflecting means for deflecting the ink droplet to impinge the ink droplet on the ink receiving member; and a collecting means for collecting ink from the ink receiving member into the ink tank, wherein the collecting means includes:

a colorant-dispersion liquid supply means for supplying colorant-dispersion liquid to the ink receiving member;

an ink suctioning means for drawing ink from the ink receiving member to the ink tank by generating suction force; and a control means for controlling the amount of the colorant-dispersion liquid that the colorant-dispersion liquid supply means supplies and the suction force of the ink suctioning means for drawing the ink.

7. The inkjet recording device according to claim 6, further comprising a detection means for detecting the amount of ink clinging on the ink receiving member, wherein the control means controls the amount of the colorant-dispersion liquid and the suction force of the ink suctioning means based on the amount of ink detected by the detection means.

8. The inkjet recording device according to claim 6, wherein the colorant-dispersion liquid is diluted solution containing at least water.

9. An inkjet recording device, comprising:

an inkjet member that ejects an ink droplet;

an ink tank that stores ink, wherein the ink is supplied to the inkjet member;

an ink receiving member that receives the ink droplet;

a deflecting means for deflecting the ink droplet to impinge the ink droplet on the ink receiving member; and a collecting means for collecting ink from the ink receiving member into the ink tank, wherein the ink receiving member is provided with an ink absorbing member and wherein the ink absorbing member is a porous member formed with pores, wherein a diameter of each pore is greater than a diameter of colorant contained in the ink.

10. The inkjet recording device according to claim 9, wherein the ink is pigmented ink, and the pigment has an average diameter of equal to or less than 150 nm.

* * * * *